United States Patent [19]

Dillinger

[11] 4,221,149

[45] Sep. 9, 1980

[54] DRIVE AND CUTTING MECHANISM

[75] Inventor: Edward G. Dillinger, Levittown, Pa.

[73] Assignee: Rohm and Haas Company, Philadelphia, Pa.

[21] Appl. No.: 961,573

[22] Filed: Nov. 17, 1978

[51] Int. Cl.[3] ..... B26D 3/28

[52] U.S. Cl. ..... 83/870; 74/89.15; 83/631; 83/746

[58] Field of Search ..... 83/870, 871, 746, 631, 83/578; 74/89.15

[56] References Cited

U.S. PATENT DOCUMENTS

| | | | |
|---|---|---|---|
| 3,802,281 | 4/1974 | Clarke | 74/89.15 |
| 3,957,568 | 5/1976 | Abel | 83/871 X |
| 3,972,254 | 8/1976 | Dillinger et al. | 83/578 X |
| 3,989,223 | 11/1976 | Burkhardt et al. | 74/89.15 X |
| 4,148,226 | 4/1979 | Benton | 74/89.15 X |

FOREIGN PATENT DOCUMENTS

| | | | |
|---|---|---|---|
| 317572 | 1/1957 | Switzerland | 83/870 |

*Primary Examiner*—Frank T. Yost

*Attorney, Agent, or Firm*—Patrick C. Baker

[57] ABSTRACT

Dual, series ball screw and ball nut array for reciprocating a cable and a cutting mechanism utilizing the array. The first ball screw is stationary while the second is moveable, spaced apart and axially aligned with the first ball screw. Ball nuts are rotatably carried on each ball screw and the ball nuts are connected as by a tube. A drive means such as an hydraulic piston activator reciprocates the movable ball screw, thereby translating and rotating the second ball nut likewise the ball nut carried on the stationary ball screw. A pulley on either ball nut or on the connecting tube activates a cable connected thereto. A cutter connected to the cable is thereby reciprocated for slicing action.

7 Claims, 5 Drawing Figures

DRIVE AND CUTTING MECHANISM

BACKGROUND OF THE INVENTION

This invention relates to drive and cutting mechanisms adapted for the slicing of textile materials such as continuously produced fusion bonded nonwoven carpets. More particularly this invention relates to a dual, series ball screw and ball nut array to drive a reciprocating cutter and cable connection, and a cutting mechanism utilizing the array.

U.S. Pat. Nos. 3,127,293, 3,657,052 and 3,972,254 describe devices for producing nonwoven carpets and other textile materials wherein a flexible sheet is continuously advanced to a cutting position. At the cutting position a cutting blade reciprocally traverses the width of the sheet to slice the sheet in a predetermined path. In one cutting mechanism, such as described in U.S. Pat. No. 3,972,254, a plurality of cutting elements are secured to an endless belt which is sprocket driven in a reciprocating fashion. In another cutting mechanism, one or more cutting elements are carried on a rope which reciprocally travels in a substantially linear path in the desired cutting plane. Each of these cutting mechanisms requires complex and massive arrangements of driving elements which are cumbersome and subject to breakdown. For example, in a rope drive cutting mechanism of the type described, a plurality of sheaves are pendulum driven. This system takes up considerable space, and tends to be inefficient due to wasted motion and breakdowns caused by wear on the numerous bearings in the array.

SUMMARY

The present invention provides a space-saving drive mechanism, and a cutting mechanism utilizing the drive mechanism, which is simple in construction and efficient in operation, particularly by reducing the large number of pulleys utilized in existing mechanisms. In the drive mechanism of the invention, a pair of ball screws are aligned axially, one of the ball screws being stationary and the other being axially movable. Each ball screw carries a ball nut thereon and the ball nuts are linked by a tubular member or similar element which rotates with the ball nuts. The pitch and thread leads of the opposing ball screws and nuts are matched but of opposite hand. A multigrooved pulley is carried on one of the ball nuts or on the linking member for rotation therewith. A reciprocating driving force acts on the translatable ball screw with the result that the reciprocating rotary motion imparted to the ball nut carried thereon is transferred to the multigrooved pulley. If the drive mechanism is utilized in a cutting mechanism wherein a rope or the like is operatively wrapped around the pulley and another idler pulley, the rope will also reciprocate in a predetermined path. One or more cutting elements mounted on the rope will thereby slice material moving transversely in the path of the cutting element or elements.

DETAILED DESCRIPTION

The invention is more fully described in the accompanying drawing wherein.

Figure 1:
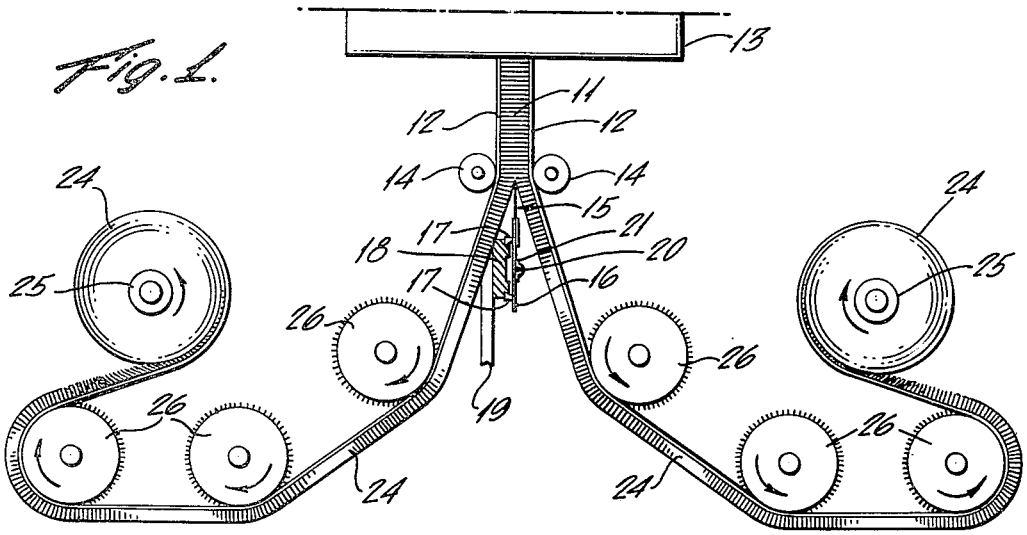
FIG. 1 is a partly schematic, elevational view showing some basic elements in a mechanism for cutting a textile material of the fusion bonded type.
Figure 2:
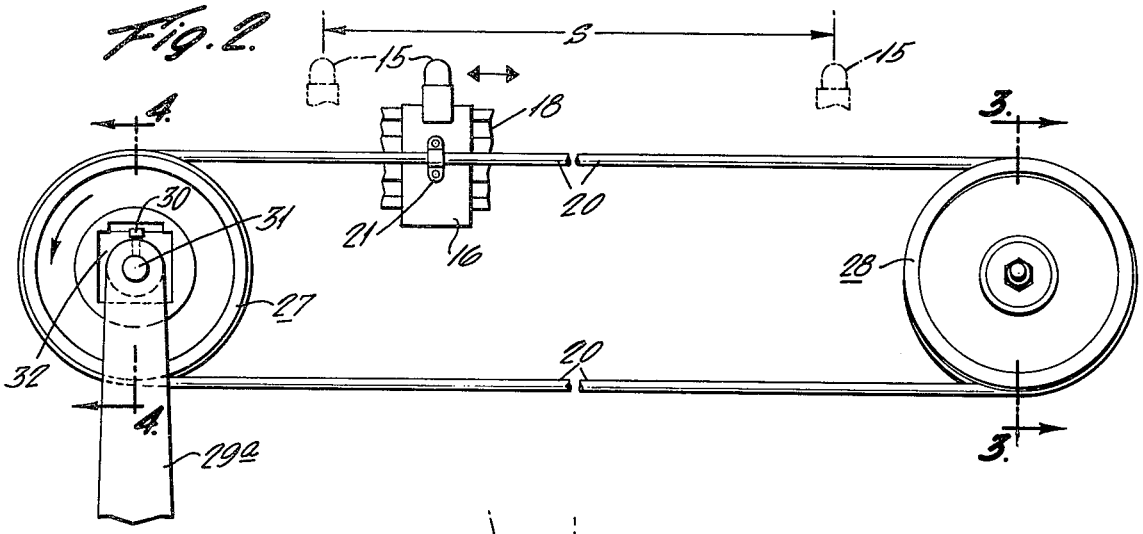
FIG. 2 is a side view of the cutting mechanism portion of FIG. 1, further showing elements of the drive and cutting mechanisms of the invention.

With reference to the drawing, FIG. 1 shows one use of the mechanisms of the invention, such as the slicing of nonwoven textile material produced as described in U.S. Pat. No. 3,127,293. In this application, as shown in FIG. 1, yarn 11 looped between backing materials 12 and adhered thereto by suitable adhesive exits from a curing oven 13 through a pair of guide rolls 14. The textile material is sliced across its width as it advances from the oven by a cutting element such as traversing knife blade 15. Blade 15 (see FIG. 2) is mounted on a carriage 16 having spring loaded shoes 17 which track in a way 18 affixed to a suitable support number 19 (FIG. 1). Carriage 16 is affixed to a rope 20 or the like (for example, a cord, chain or cable) by a suitable connector such as clamp 21. In the conventional arrangement shown in FIG. 1, the cutting blade 15 is reciprocated by reciprocation of a rope to which the blade carriage is connected. In a conventional drive mechanism for reciprocating the rope, a pendulum system is utilized which is linked to the rope through a plurality of pulleys (not shown). As the yarn 11 is sliced, two sheets of textile material such as carpets 24 are formed which are then taken up on rolls 25 after passing over pin rolls 26.

Figure 3:
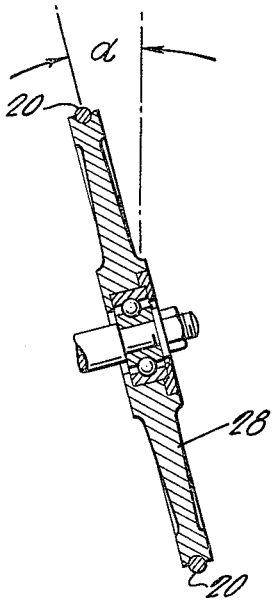
FIG. 3 is a section along the line 3—3 of FIG. 2.

In one embodiment of the drive mechanism of the invention (FIGS. 2–5), an endless rope 20 carrying the blade 15, is wrapped around a driven pulley such as sheave 27 and an idler pulley such as sheave 28. Sheave 27 is multi-grooved to provide frictional engagement with rope 20. Sheave 28 is singly grooved. It will be understood, however, that the invention may be used with operating elements other than ropes, such as belts, chains, cables or the like. In the embodiment of the invention applicable to cutting mechanisms for slicing textile materials, however, it is preferred to use a rope to move the cutting element. Sheave 28 is skewed from the vertical an angle alpha, as shown in FIG. 3, for reasons explained below.

Figure 4:
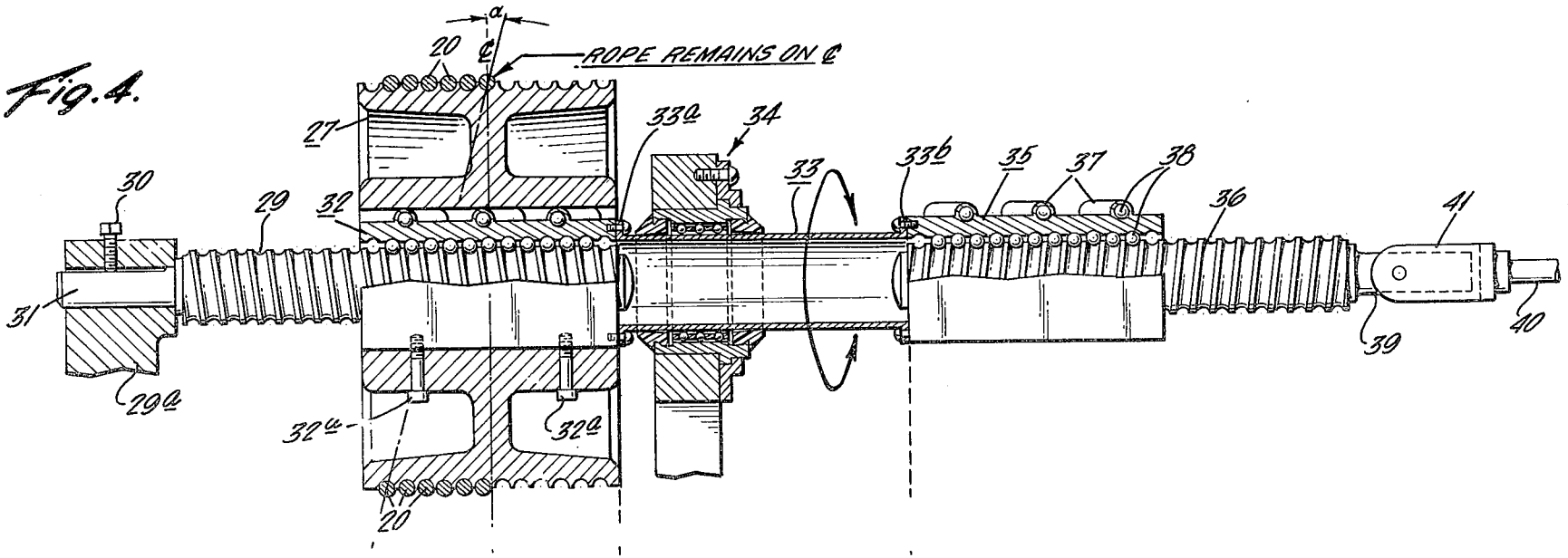
FIG. 4 is a partly schematic section along the line 4—4 of FIG. 2.
Figure 5:
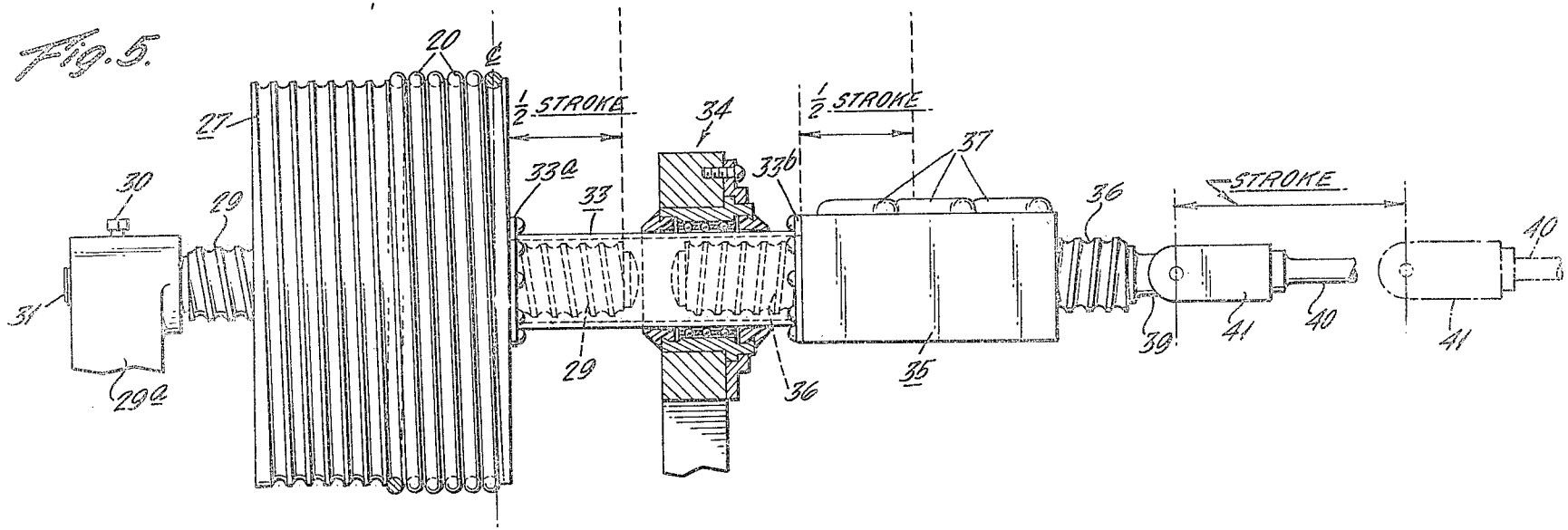
FIG. 5 is a view similar to FIG. 4 showing another position of elements of FIG. 4 when actuated.

With reference to FIGS. 4 and 5, one embodiment of the drive mechanism of the invention includes a ball screw 29 which is held stationary on a support **29*a* by a set screw 30 which locks onto ball screw shaft 31. A ball nut 32 rotatably rides on ball screw 29 and carries sheave 27 which is affixed to ball nut 32 by set screws 32*a*. A torque and thrust tube 33 is connected to one end of ball nut 32 through a flange 33*a*. Preferably, tube 33 is rotatably supported in a sleeve journal, preferably a ball support sleeve 34. The opposing flanged end 33*b* of tube 33 is connected to a second ball nut 35 of hand opposite that of first ball nut 32. Ball nut 35 is rotatably carried on a second ball screw 36 which is translatable axially with respect to first ball screw 29** but is not rotatable.

Ball nuts 32 and 35 in combination with respective ball screws 29 and 36 are known elements such as the systems available from the Saginaw Steering Gear Division of General Motors Corporation. These power transmission screw systems include return tubes 37 for the ball bearings 38. As the screw and nut rotate relative to each other, the bearing balls divert from one end and are carried by ball guides to the opposite end of the nut. This recirculation permits unrestricted travel of the nut in relation to the screw and thus provides highly efficient power transmission when a driving force is applied to either the screw or the nut. For example, it is estimated that the efficiency of a ball screw to ball nut thrust to rotation motion conversion is not less than 80% and the efficiency of translating a ball nut restricted to rotation by ball splines is not less than 90%, thus yielding an operating mechanism whose efficiency is not less than 72%. Similarly, tube 33 and its support sleeve 34 is a conventional arrangement such as the combination of linear and rotary motion provided by ball sleeves and shafts such as "ROTOLIN" (trademark) ball bearing types ML or MLF available from Landis & Gyr, Inc., Elmsford, New York.

Ball screw 36 has a shaft 39 which is actuated by an actuator rod 40 linked to the shaft through a clevis or yoke 41. Any suitable driving force capable of providing reciprocal motion may be used to actuate the drive mechanism of FIGS. 4 and 5 through rod 40, such as an hydraulic piston activator the speed of which may be adjusted as desired.

In operation, a translating but not rotating driving force reciprocates ball screw 36 from a rest position as shown in FIG. 4 through a stroke with the result, as shown in FIG. 5, that ball nut 35 is rotated and translated a distance equal to a fraction of the stroke, such distance being dependent upon various dimensions of the elements of the array such as the pitch of the threads of ball screws 36 and 29. For example, in preferred embodiment the geometry of ball screw 29, ball nut 32 and sheave 27 is matched to the geometry of ball screw 36, ball nut 35 and sheave 28, particularly with respect to pitch and thread lead, except for opposite hand. Sheave 27 will thereby be translated the same fractional distance as ball nut 35, the resulting rotation causing rope 20 thereon to be reciprocated over a distance which is a function of the stroke of the drive mechanism. When, for example, the input stroke is twice the translation distance of ball nut 32 and sheave 27, a two to one mechanical advantage is obtained. If the screw leads are ½ inch and the input stroke is 6 inches, nut 32 will translate 3 inches and sheave 27 will make six revolutions. When the drive mechanism is used to reciprocate a rope 20 between sheaves 27 and 28 (FIG. 2), the distance of travel of the rope will depend upon the foregoing conditions and the elements of the array may be sized accordingly.

As indicated above, however, the use of a multigrooved sheave 27 requires that sheave 28 be skewed (while providing matched thread leads and hands of sheave 27, ball nut 32 and ball screw 29) so that the exit and entry positions of the rope 20 on sheave 27 will be substantially stationary in space as sheave 27 rotates and translates. This is shown in FIGS. 4 and 5 wherein it will be seen that rope 20 remains on center in both the rest position shown in FIG. 4 and in the stroke position shown in FIG. 5. It will be further noted that the skew angle alpha (FIG. 3) is equal to the angle alpha formed by the center line and the line of deviation between the entry and exit positions of rope 20 on sheave 27 (FIG. 4). In consequence, rope 20 remains substantially in the same path relative to sheaves 27 and 28, and cutter blade 15 likewise can be maintained in substantially the same linear path relative to ground. For example, if it is desired to reciprocate the blade and its carriage along guideways 17.66 feet, a sheave 27 as well as ball screws and ball nuts will be selected having ½ inch leads. When combining these dimensions with a sheave 27 having a pitch diameter of 11.13 inches and wrapping the rope 20 six and a half turns around sheave 27 while utilizing an input reciprocating stroke of 6 inches, sheave 27 will be caused to rotate six turns and translate 3 inches. Rope 20 will thereby be caused to alternately play out 17.66 feet and rewind 17.66 feet while maintaining a path which remains substantially parallel to the guided way. It will, of course, be understood that other screw leads, strokes and sheave diameters may be used depending upon the desired output and input stroke lengths.

It will be understood that the invention is not limited to the foregoing description and the embodiment illustrated by the appended drawing but extends to all mechanisms within the scope and spirit of the appended claims.

I claim:

1. In a drive mechanism the combination of a stationary first ball screw, a first ball nut rotatably carried on said first ball screw, a second ball screw axially aligned with said first ball screw and spaced apart therefrom, a second ball nut rotatably carried on said second ball screw, drive means acting on said second ball screw to reciprocally translate said second ball screw, means connecting said first and second ball nuts whereby said first ball nut is reciprocated in response to actuation of said drive means, and a driven pulley mounted on one of said first ball nut, said second ball nut and said connecting means for rotation and translation therewith, whereby said driven pulley reciprocally rotates and translates in response to actuation of said drive means.

2. A drive mechanism as in claim 1 wherein said pulley comprises a sheave.

3. A drive mechanism as in claim 1 wherein said connecting means comprises a tube.

4. A drive mechanism as in claim 3 wherein said connecting means further includes a bearing supporting said tube.

5. A cutting mechanism comprising, in combination: a drive mechanism comprising the combination of a stationary first ball screw, a first ball nut rotatably carried on said first ball screw, a second ball screw axially aligned with said first ball screw and spaced apart therefrom, a second ball nut rotatably carried on said second ball screw, drive means acting on said second ball screw to reciprocally translate said second ball screw, means connecting said first and second ball nuts whereby said first ball nut is reciprocated in response to actuation of said drive means, and a driven pulley mounted on said first ball nut, said second ball nut or said connecting means for rotation and translation therewith; said cutting mechanism additionally including an idler pulley spaced apart from said driven pulley, a rope or the like operatively carried on and connecting said pulleys, and a cutter blade affixed to said rope, whereby said driven pulley reciprocally rotates and translates in response to actuation of said drive means and said blade is reciprocated between said pulleys.

6. A cutting mechanism as in claim 5 wherein said driven pulley is a multigrooved sheave and the idler pulley is a single grooved sheave, said rope is wrapped about said multigrooved sheave a plurality of turns, and said idler pulley is skewed such that the entry and exit positions of the rope on the multigrooved sheave remain substantially constant and said cutter blade travels in substantially the same path when reciprocated between said pulleys.

7. A cutting mechanism as in claim 6 further including a carriage holding said blade, said rope being connected to said carriage, and a way for guiding said carriage.

* * * * *